US009365328B1

(12) United States Patent
Johnson

(10) Patent No.: US 9,365,328 B1
(45) Date of Patent: Jun. 14, 2016

(54) TOOTHPASTE TUBE ROLLING DEVICE

(71) Applicant: Maurice Johnson, West Valley City, UT (US)

(72) Inventor: Maurice Johnson, West Valley City, UT (US)

( * ) Notice: Subject to any disclaimer, the term of this patent is extended or adjusted under 35 U.S.C. 154(b) by 8 days.

(21) Appl. No.: 14/600,709

(22) Filed: Jan. 20, 2015

(51) Int. Cl.
*B65D 35/34* (2006.01)

(52) U.S. Cl.
CPC ..... *B65D 35/34* (2013.01)

(58) Field of Classification Search
CPC ..... B65D 35/34; B65D 35/28; B65D 35/56
USPC ..... 222/97–101, 103
See application file for complete search history.

(56) References Cited

U.S. PATENT DOCUMENTS 3,885,708 A * 5/1975 Parry ..... B65D 35/34 222/100
3,920,157 A * 11/1975 Yeung ..... B65D 35/34 222/100
5,845,813 A 12/1998 Werner
5,957,334 A 9/1999 Rosario
5,975,363 A 11/1999 Haycock
8,752,733 B2 * 6/2014 Rosaen ..... B65D 35/32 222/100

* cited by examiner

*Primary Examiner* — Kevin P Shaver
*Assistant Examiner* — Robert Nichols, II
(74) *Attorney, Agent, or Firm* — Crossley & Stevenson IP Law

(57) ABSTRACT

A toothpaste tube rolling device including a single-piece clamp having a top and a bottom lever portion. A tongue extends from the front side of the bottom lever, and a tapered extension is disposed on each of the right and left sides of the top lever portion. A circular opening is disposed on each tapered extension proximal the front edge. A substantially cylindrical tube having a top and bottom wall is configured to fit within the circular opening of the tapered extension. A clamping ring having a C-shaped forward and rearward portion is disposed around the tube. A spring clamping tab with a top extension, a bottom extension, and a V-shaped central portion is centrally disposed between the forward and rearward portions. The spring clamping tab has an open position and an alternate closed position and is disposed within the space between the top and bottom wall of the tube.

8 Claims, 6 Drawing Sheets

TOOTHPASTE TUBE ROLLING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of tube rolling devices are known in the prior art. However, what is needed is a toothpaste tube rolling device including a single-piece clamp having a top lever portion and a bottom lever portion, with a tongue extending from the front side of the bottom lever. What has further been needed is a tapered extension disposed on the right side and the left side of the top lever portion, with an opening medially disposed proximal the front side of the top lever of the clamp in a size that is configured to receive a user's finger. In addition, what has been needed is a substantially cylindrical tube that is configured to fit within the circular opening of the tapered extensions, a slot disposed through the top wall and the bottom wall of the tube, a space washer disposed in the slot, a stop body disposed on the right wall of the tube, a knob disposed on the right face of the tube, and a locking pin configured to engage a vertical opening disposed through the space washer, the top wall, and the bottom wall of the tube. Lastly, what has been needed is a clamping ring disposed around the tube, and a spring clamping tab centrally disposed between the forward and rearward portions of the clamping ring, so that the end of a toothpaste tube can be inserted between the spring clamping tab and the knob can be manually rotated to simultaneously rotate the tube and the clamping ring counterclockwise.

FIELD OF THE INVENTION

The present invention relates to tube rolling devices, and more particularly, to a device for squeezing, rolling and dispensing collapsible toothpaste tubes.

SUMMARY OF THE INVENTION

The general purpose of the present toothpaste tube rolling device, described subsequently in greater detail, is to provide a tube rolling device which has many novel features that result in a toothpaste tube rolling device which is not anticipated, rendered obvious, suggested, or even implied by prior art, either alone or in combination thereof.

To accomplish this, the present toothpaste tube rolling device comprises a single-piece clamp having a top lever portion and a bottom lever portion, with each of the top lever portion and the bottom lever portion having a front side, a back side, an interior surface, an exterior surface, a left side, and a right side. The top and bottom lever portions are conjoined at a C-shaped center portion on the back side of the clamp. The top lever portion has a width greater than a width of the bottom lever portion. A tongue extends from the front side of the bottom lever and is directed away from the top lever. A tapered extension is disposed at each of the right and left sides of the top lever portion. Each tapered extension has an upper edge that is contiguous with the exterior surface of the top lever portion, a lower edge terminating beyond the exterior surface of the bottom lever portion, and a front edge substantially aligned with a midpoint of a length of the tongue. An opening is medially disposed proximal the front side of the top lever of the clamp, and the opening has a size configured to receive a user's finger therethrough. A circular opening is disposed proximal the front edge on each tapered extension.

A cylindrical tube has a top wall and a bottom wall, with each of the top wall and the bottom wall having an external surface, an internal surface, a left wall, a right wall, a forward end, and a rearward end. The tube is configured to fit within the circular opening of the tapered extension and to substantially conform to the size of the circular opening. The tube can be made of plastic. A slot is continuously disposed between the top wall and the bottom wall, and a space washer is disposed in the slot proximal the left wall. A stop body having a width greater than the diameter of the circular opening is disposed on the right wall. A knob is also disposed on the right wall of the tube. The knob is manually rotatable. A vertical opening is continuously disposed through the top wall, the space washer, and the bottom wall. The vertical opening is medially disposed through the space washer. A locking pin, which has an upper head and a vertically split base, is configured to engage the vertical opening and to substantially conform to a size of the vertical opening. The locking pin is insertable through the vertical opening on the clamping ring.

A clamping ring has a C-shaped forward portion and a C-shaped rearward portion, with each of the forward and rearward portions having a convex top portion and a continuous front aperture. The clamping ring is configured to snuggly engage an outer perimeter of the tube. The clamping ring is disposed around the circular tube, and the top extension of the spring clamping tab is disposed within the space between the top wall and the bottom wall of the tube. A gap is disposed between the top portion of the forward and rearward portion of the clamping ring. A lower lip is continuously disposed along and between the forward and rearward portions of the clamping ring. A protruding tooth is disposed on each of an end of the C-shaped forward portion of the clamping ring. The tube has an indentation on each of the top wall and the bottom wall of the left wall. The protruding teeth on the clamping ring are configured to snuggly latch into the indentations on the tube.

A spring clamping tab is centrally disposed between the forward and rearward portions, with the spring clamping tab having a top extension, a bottom extension, and a V-shaped central portion disposed between the top and bottom extensions. Each of the top and bottom extensions have a distal end, an interior surface, and an exterior surface. The V-shaped central portion engages and alternately disengages the lower lip between the forward and rearward portions of the clamping ring.

The clamping tab has an open position and an alternate closed position. The top extension of the spring clamping tab is disposed proximal to the rearward end of the top wall of the tube in the closed position. The top extension of the spring clamping tab is proximal to the rearward end of the bottom wall of the tube in the open position. In the open position, the base of a toothpaste tube can be inserted between the top extension and the bottom extension of the spring clamping tab. Each of the tube and the clamping ring rotates counterclockwise when the knob is rotated. The spring clamping tab can have a rubberized coating in order to better grip the end of a toothpaste tube.

BRIEF DESCRIPTION OF THE DRAWINGS

Figures

DETAILED DESCRIPTION OF THE DRAWINGS

Figure 1:
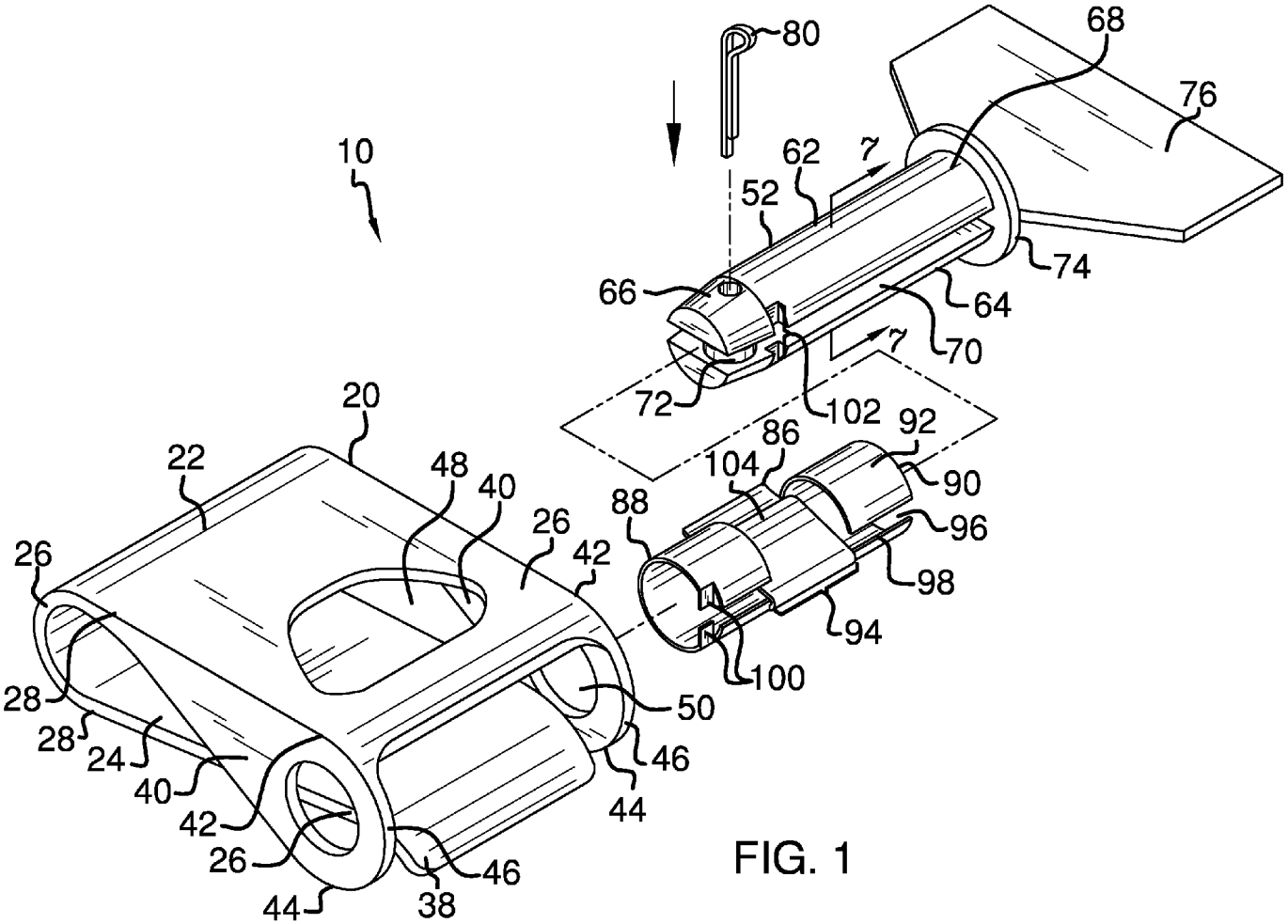
FIG. 1 is an exploded isometric view.
Figure 2:
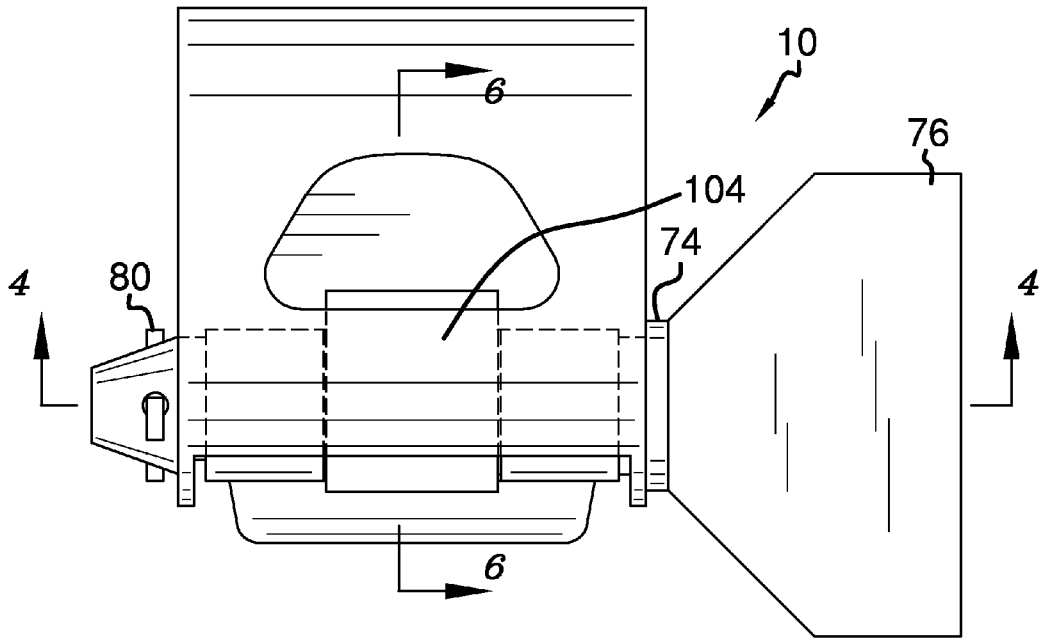
FIG. 2 is a top plan view.
Figure 3:
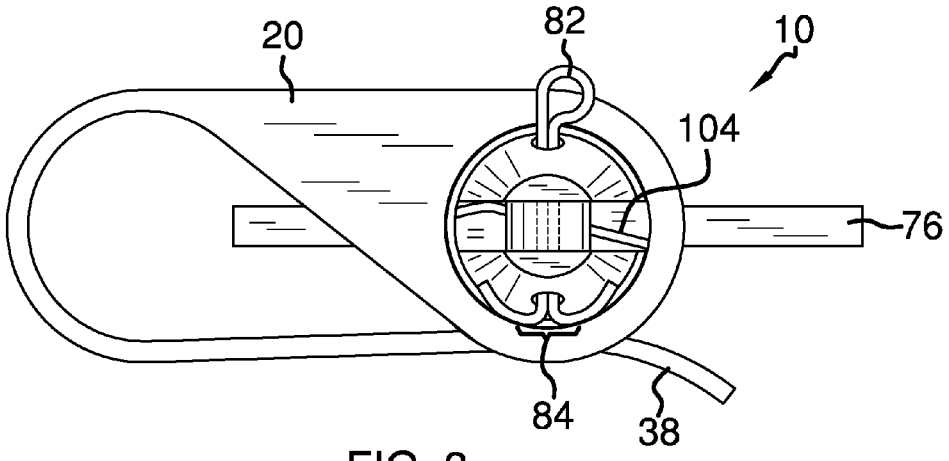
FIG. 3 is a side elevation view.

With reference now to the drawings, and in particular FIGS. 1 through 8 thereof, an example of the instant toothpaste tube rolling device employing the principles and concepts of the present toothpaste tube rolling device and generally designated by the reference number 10 will be described.

Referring to FIGS. 1 through 8 the present toothpaste tube rolling device 10 is illustrated. The toothpaste tube rolling device 10 includes a single-piece clamp 20 having a top lever portion 22, a bottom lever portion 24, each of the top lever portion 22 and the bottom lever portion 24 having a front side 26, a back side 28, an interior surface 30, an exterior surface 32, a left side 34, and a right side 36, the top lever portion 22 and bottom lever portion 24 being conjoined at a C-shaped center portion 26 on the back side 28. The top lever portion 22 has a width greater than a width of the bottom lever portion 24. A tongue 38 extends from the front side of the bottom lever portion 24 and is directed away from the top lever portion 22. A tapered extension 40 is disposed on each of the right and left sides 36, 34 of the top lever portion 22. The extension 40 has an upper edge 42 contiguous with the exterior surface 32 of the top lever portion 22, a lower edge 44 terminating beyond the exterior surface 32 of the bottom lever portion 24, and a front edge 46 substantially aligned with a midpoint of a length of the tongue 38. An opening 48 is medially disposed proximal the front side 26 of the top lever portion 22 of the clamp 20. The opening 48 has a size configured to receive a user's finger therethrough. A circular opening 50 is disposed on each extension 40 proximal the front edge 46.

Figure 4:
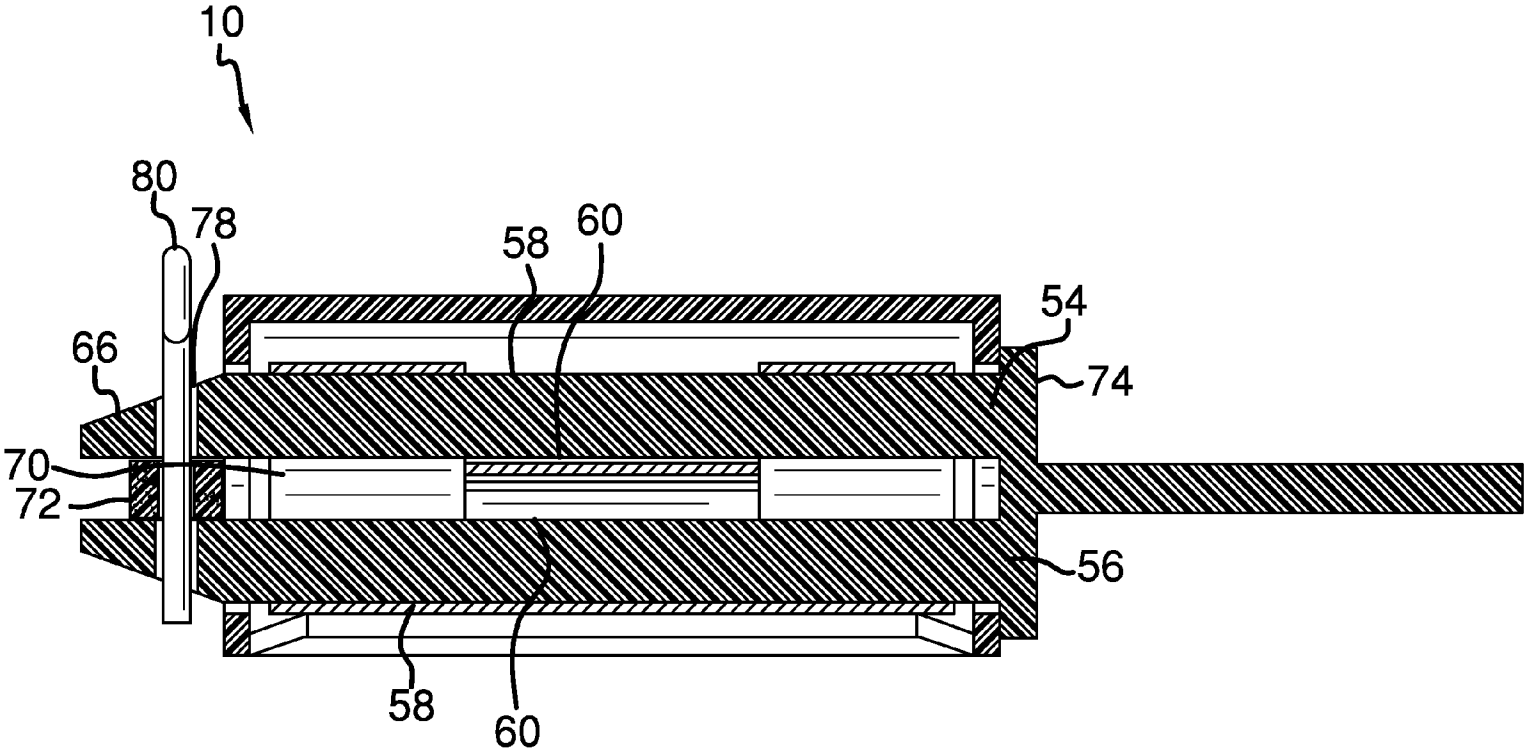
FIG. 4 is a cross sectional view taken along line 4-4 of FIG. 2.
Figure 5:
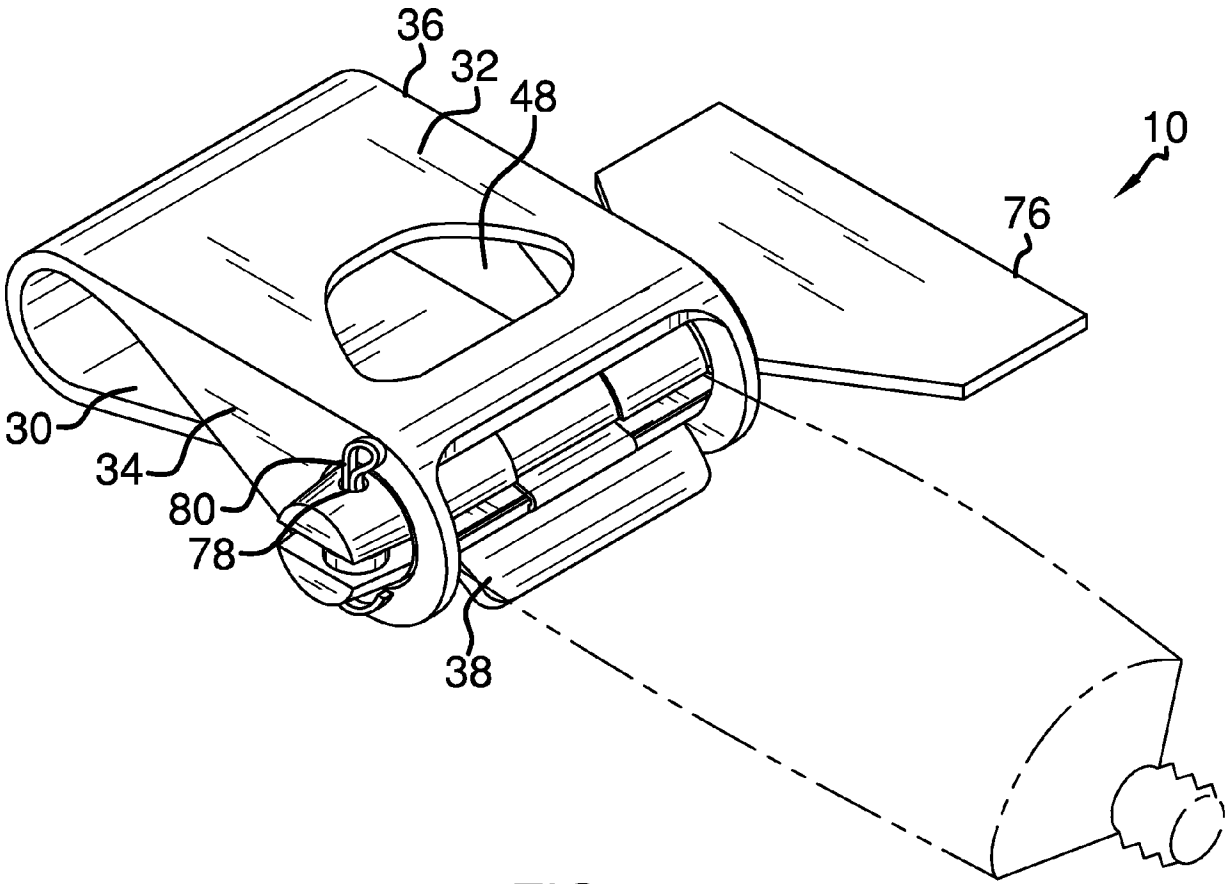
FIG. 5 is an in-use isometric view.
Figure 6:
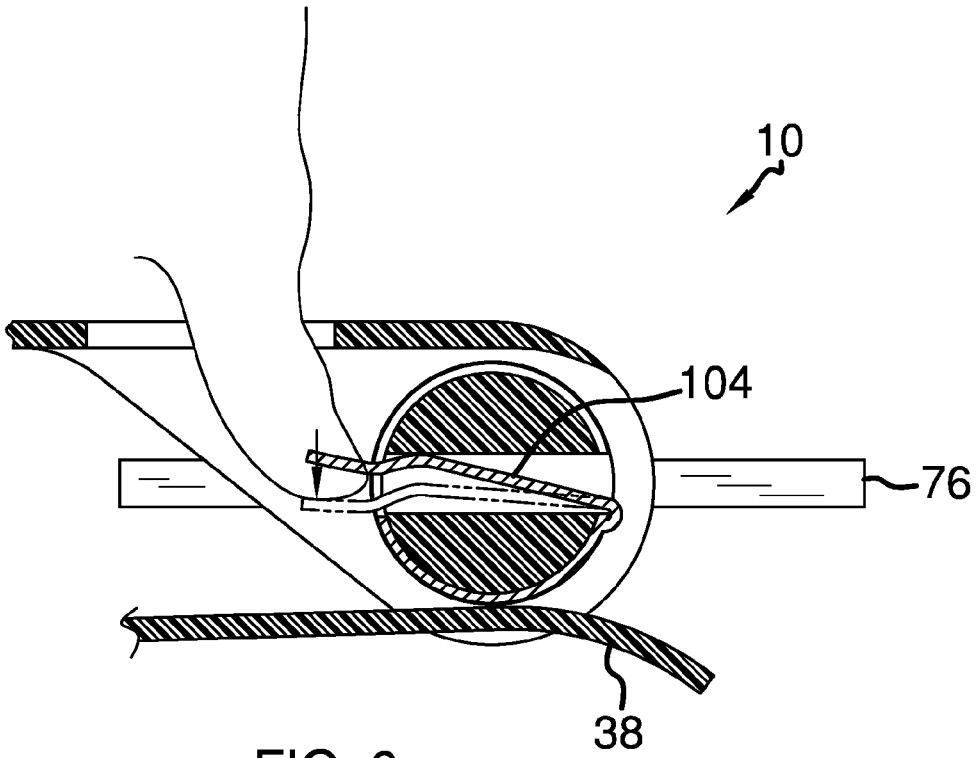
FIG. 6 is a side view.
Figure 7:
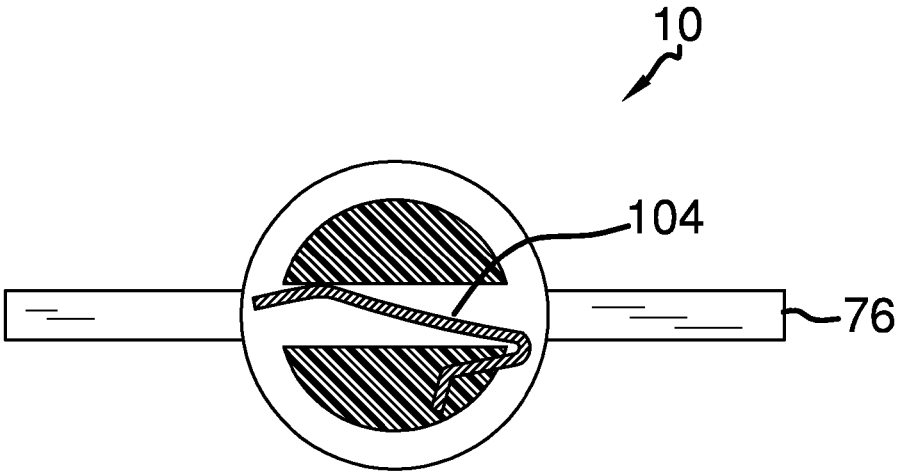
FIG. 7 is a cross sectional view taken along line 7-7 of FIG. 1.
Figure 8:
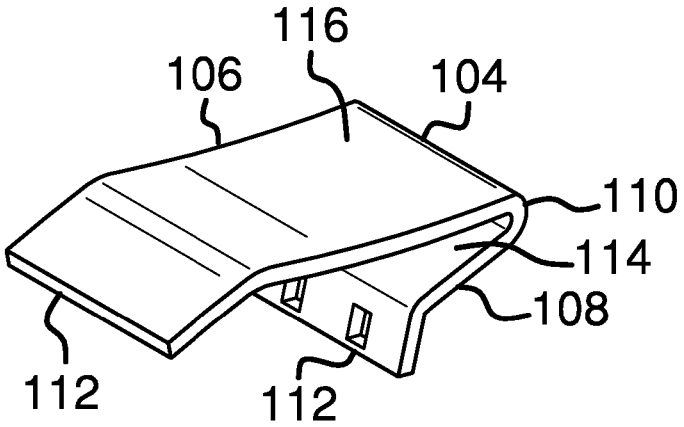
FIG. 8 is an isometric view of the clamping tab.

As best shown in FIGS. 1 and 4, a substantially cylindrical tube 52 has a top wall 54 and a bottom wall 56, with each of the top wall 54 and the bottom wall 56 having an external surface 58, an internal surface 60, a left wall 62, a right wall 64, a forward end 66, and a rearward end 68. The tube 52 is configured to fit within the circular opening 50 of the extension 40 and to substantially conform to a size of the circular opening 50. The tube 52 can be plastic as shown in FIG. 4.

As best shown in FIG. 4, a slot 70 is continuously disposed between the top wall 54 and the bottom wall 56. A space washer 72 is disposed in the slot 70 proximal the left wall 62. A stop body 74 is disposed on the right wall 64. The stop body 74 has a width greater than the diameter of the circular opening 50. A knob 76 is disposed on the right wall 64. A vertical opening 78 is continuously disposed through the top wall 54, the space washer 72, and the bottom wall 56. The vertical opening 78 is medially disposed through the space washer 72. A locking pin 80 is configured to engage the vertical opening 78. The locking pin 80 has an upper head 82 and a vertically split base 84. The locking pin 80 is insertable through the vertical opening 78.

A clamping ring 86 has a C-shaped forward portion 88 and a C-shaped rearward portion 90, with each of the forward and rearward portions 88, 90 having a convex top portion 92 and a continuous front aperture 94. The clamping ring 86 is configured to snuggly engage an outer perimeter of the tube 52. The clamping ring 86 is disposed around the tube 52. A gap 96 is disposed between the top portion 92 of the forward and rearward portions 88, 90. A lower lip 98 is continuously disposed along and between the forward and rearward portions 88, 90. A protruding tooth 100 is disposed on each of an end of the C-shaped forward portion 88 of the clamping ring 86. The tube 52 has an indentation 102 on each of the top wall 54 and the bottom wall 56 of the left wall 62. The protruding teeth 100 are configured to snuggly latch into the indentations 102.

A spring clamping tab 104 is centrally disposed between the forward and rearward portions 88, 90. The spring clamping tab 104 has a top extension 106, a bottom extension 108, and a V-shaped central portion 110 disposed between the top and bottom extensions 106, 108. Each of the top and bottom extensions 106, 108 have a distal end 112, an interior surface 114, and an exterior surface 116. The V-shaped central portion 110 engages and alternately disengages the lower lip 98 between the forward and rearward portions 88, 90. The spring clamping tab 104 has an open position and an alternate closed position. The top extension 106 of the spring clamping tab 104 is disposed proximal to the rearward end 68 of the top wall 54 of the tube 52 in the closed position. The top extension 106 of the spring clamping tab 104 is disposed proximal to the rearward end 68 of the bottom wall 56 of the tube 52 in the open position. The spring clamping tab 104 can have a rubberized coating 118.

What is claimed is:

1. A toothpaste tube rolling device comprising:

a single-piece clamp having a top lever portion, a bottom lever portion, each of the top lever portion and the bottom lever portion having a front side, a back side, an interior surface, an exterior surface, a left side, and a right side, the top and bottom lever portions being conjoined at a C-shaped center portion on the back side thereof;

wherein the top lever portion has a width greater than a width of the bottom lever portion;

a tongue extending from the front side of the bottom lever, wherein the tongue is directed away from the top lever;

a tapered extension disposed on each of the right and left sides of the top lever portion, wherein the extension has an upper edge contiguous with the exterior surface of the top lever portion, a lower edge terminating beyond the exterior surface of the bottom lever portion, and a front edge substantially aligned with a midpoint of a length of the tongue;

an opening medially disposed proximal the front side of the top lever of the clamp, the opening having a size configured to receive a user's finger therethrough;

a circular opening disposed on each tapered extension proximal the front edge;

a substantially cylindrical tube having a top wall and a bottom wall, each of the top wall and the bottom wall having an external surface, an internal surface, a left wall, a right wall, a forward end, and a rearward end, wherein the tube is configured to fit within the circular opening of the tapered extension and to substantially conform to a size of the circular opening;

a slot continuously disposed between the top wall and the bottom wall;

a space washer disposed in the slot proximal the left wall;

a stop body disposed on the right wall, the stop body having a width greater than the diameter of the circular opening;

a knob disposed on the right wall;

a vertical opening continuously disposed through the top wall, the space washer, and the bottom wall, wherein the vertical opening is medially disposed through the space washer;

a locking pin configured to engage the vertical opening and to substantially conform to a size of the vertical opening, the locking pin having an upper head and a vertically split base;

a clamping ring having a C-shaped forward portion and a C-shaped rearward portion, each of the forward and rearward portions having a convex top portion, a continuous front aperture, wherein the clamping ring is configured to snuggly engage an outer perimeter of the tube;

a gap between the top portion of the forward and rearward portions;

a lower lip continuously disposed along and between the forward and rearward portions; and a spring clamping tab centrally disposed between the forward and rearward portions, the spring clamping tab having a top extension, a bottom extension, and a V-shaped central portion disposed between the top and bottom extensions, each of the top and bottom extensions having a distal end, an interior surface, and an exterior surface;

wherein the V-shaped central portion engages and alternately disengages the lower lip between the forward and rearward portions.

2. The toothpaste tube rolling device of claim 1 wherein the clamping ring is disposed around the circular tube and the top extension of the spring clamping tab is disposed within the space between the top wall and the bottom wall of the tube;

wherein the spring clamping tab has an open position and an alternate closed position;

wherein the top extension of the spring clamping tab is disposed proximal to the rearward end of the top wall of the tube in the closed position;

wherein the top extension of the spring clamping tab is disposed proximal to the rearward end of the bottom wall of the tube in the open position.

3. The toothpaste tube rolling device of claim 2 wherein the locking pin is insertable through the vertical opening on the clamping ring.

4. The tooth tube rolling device of claim 2 wherein the knob is manually rotatable, wherein upon the rotation of the knob, each of the tube and the clamping ring rotates counterclockwise.

5. The toothpaste tube rolling device of claim 2 wherein a protruding tooth is disposed on each of an end of the C-shaped forward portion of the clamping ring, wherein the tube has an indentation disposed on each of the top wall and the bottom wall of the left wall, wherein the protruding teeth are configured to snuggly latch into the indentations.

6. The toothpaste tube rolling device of claim 1 wherein the tube is plastic.

7. The toothpaste tube rolling device of claim 1 wherein the spring clamping tab has a rubberized coating.

8. A toothpaste tube rolling device comprising:

a single-piece clamp having a top lever portion, a bottom lever portion, each of the top lever portion and the bottom lever portion having a front side, a back side, an interior surface, an exterior surface, a left side, and a right side, the top and bottom lever portions being conjoined at a C-shaped center portion on the back side thereof;

wherein the top lever portion has a width greater than a width of the bottom lever portion;

a tongue extending from the front side of the bottom lever, wherein the tongue is directed away from the top lever;

a tapered extension disposed on each of the right and left sides of the top lever portion, wherein the extension has an upper edge contiguous with the exterior surface of the top lever portion, a lower edge terminating beyond the exterior surface of the bottom lever portion, and a front edge substantially aligned with a midpoint of a length of the tongue;

an opening medially disposed proximal the front side of the top lever of the clamp, the opening having a size configured to receive a user's finger therethrough;

a circular opening disposed on each tapered extension proximal the front edge;

a substantially cylindrical tube having a top wall and a bottom wall, each of the top wall and the bottom wall having an external surface, an internal surface, a left wall, a right wall, a forward end, and a rearward end, wherein the tube is configured to fit within the circular opening of the tapered extension and to substantially conform to a size of the circular opening;

wherein the tube is plastic;

a slot continuously disposed between the top wall and the bottom wall;

a space washer disposed in the slot proximal the left wall;

a stop body disposed on the right wall, the stop body having a width greater than the diameter of the circular opening;

a knob disposed on the right wall;

wherein the knob is manually rotatable;

a vertical opening continuously disposed through the top wall, the space washer, and the bottom wall, wherein the vertical opening is medially disposed through the space washer;

a locking pin configured to engage the vertical opening and to substantially conform to a size of the vertical opening, the locking pin having an upper head and a vertically split base;

wherein the locking pin is insertable through the vertical opening on the clamping ring;

a clamping ring having a C-shaped forward portion and a C-shaped rearward portion, each of the forward and rearward portions having a convex top portion, a continuous front aperture, wherein the clamping ring is configured to snuggly engage an outer perimeter of the tube;

wherein the clamping ring is disposed around the circular tube;

a gap between the top portion of the forward and rearward portions;

a lower lip continuously disposed along and between the forward and rearward portions;

a protruding tooth is disposed on each of an end of the C-shaped forward portion of the clamping ring, the tube having an indentation on each of the top wall and the bottom wall of the left wall, wherein the protruding teeth are configured to snuggly latch into the indentations; and a spring clamping tab centrally disposed between the forward and rearward portions, the spring clamping tab having a top extension, a bottom extension, and a V-shaped central portion disposed between the top and bottom extensions, each of the top and bottom extensions having a distal end, an interior surface, and an exterior surface;

wherein the V-shaped central portion engages and alternately disengages the lower lip between the forward and rearward portions;

wherein the spring clamping tab has a rubberized coating;

wherein the top extension of the spring clamping tab is disposed within the space between the top wall and the bottom wall of the tube, wherein upon the rotation of the knob, each of the tube and the clamping ring rotates counterclockwise;

wherein the spring clamping tab has an open position and an alternate closed position;

wherein the top extension of the spring clamping tab is disposed proximal to the rearward end of the top wall of the tube in the closed position;

wherein the top extension of the spring clamping tab is disposed proximal to the rearward end of the bottom wall of the tube in the open position.

* * * * *